United States Patent [19]

Stine

[11] Patent Number: 4,726,787

[45] Date of Patent: Feb. 23, 1988

[54] MINIATURE ELECTRICAL SHUNT CONNECTOR

[75] Inventor: Jon D. Stine, Elizabethtown, Pa.

[73] Assignee: AMP Incorporated, Harrisburg, Pa.

[21] Appl. No.: 944,087

[22] Filed: Dec. 22, 1986

[51] Int. Cl.[4] ..... H01R 31/08

[52] U.S. Cl. ..... 439/510

[58] Field of Search ..... 339/18 R, 18 C, 19, 339/217.5, 222; 439/507-515

[56] References Cited

U.S. PATENT DOCUMENTS

| | | | |
|---|---|---|---|
| 4,383,724 | 5/1983 | Verhoeven | 339/19 |
| 4,602,834 | 7/1986 | Hahn et al. | 339/19 |
| 4,607,899 | 8/1986 | Romine et al. | 339/19 |

OTHER PUBLICATIONS

Elco Product Bulletin, "Mini-Bit Switching Connector Series 9067", Publ. No. C-094, 9-84, Elco Corporation, Huntingdon, Pa.

Elco Product Bulletin, "EL-BIT Switch Connector Series 8261, .100 Centers", Publ. No. C-095, 9-84, Elco Corporation, Huntingdon, Pa.

Connectral Product Catalog, pp. 17-18, "Shunts to a Pitch of 2.54 nm", Connectral, Suresnes, France.

Honda Product Bulletin, "Honda Connectors DIC Series".

Molex Product Catalog, p. 102A, "0.100" (254 nm) Center Micro Shunt",Molex Corporation.

AMP do Brasil Product Bulletin B-86-001, "AMP Novo Shunt, P.N. 880584", 8/86, AMP do Brasil, Sao Paolo, Brazil.

*Primary Examiner*—Neil Abrams

*Attorney, Agent, or Firm*—Anton P. Ness

[57] ABSTRACT

A miniature shunt connector has a shunt stamped with coplanar pairs of cantilever beams and inserted into a cavity of a low-profile housing which intersects a pair of post-receiving cavity portions. The adjacent inner shunt beams include downward projections which latch behind a latching aperture of the housing upon full shunt insertion, with the pairs of cantilever beams disposed along and on each side of centerlines of the post-receiving cavity portions and adapted to be deflected outwardly by respective terminal posts entering the shunt connector along the centerlines. The housings may be dimensioned and shaped for vertical and side-by-side stacking to shunt pairs of an array of terminal posts.

6 Claims, 5 Drawing Figures

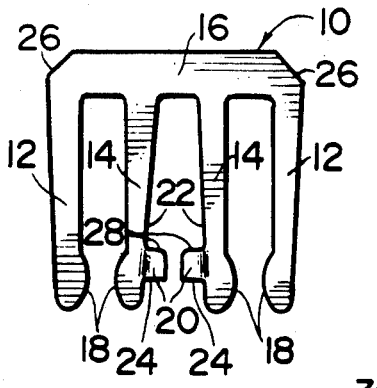
FIG. 1
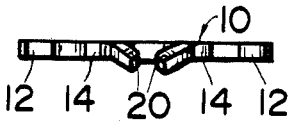
FIG. 2
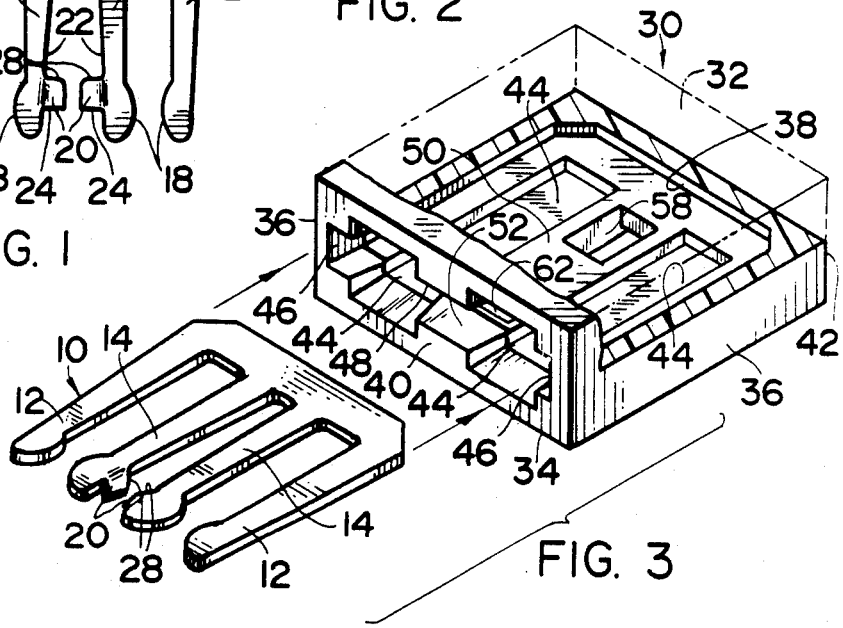
FIG. 3
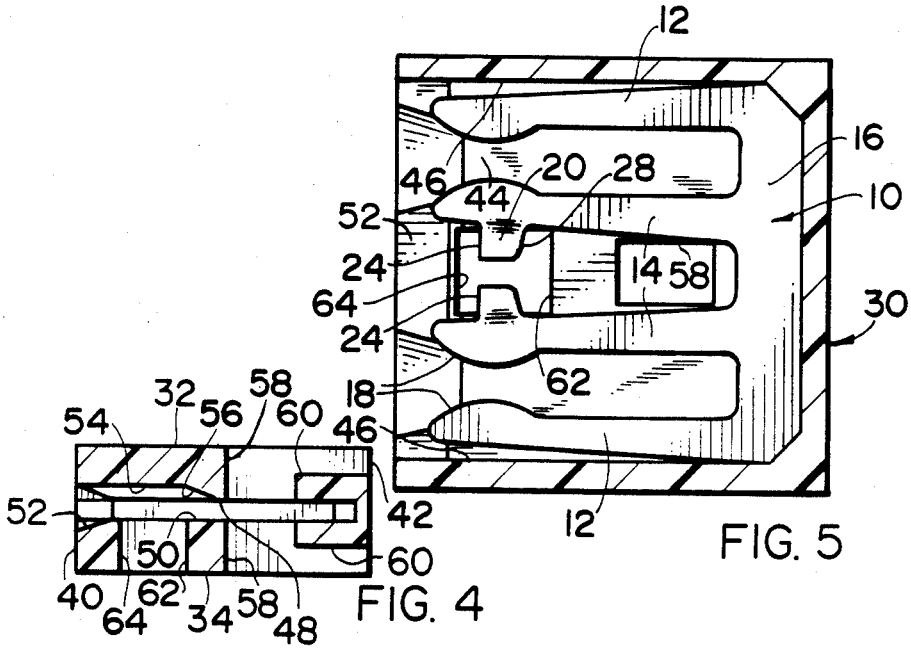
FIG. 5
FIG. 4

MINIATURE ELECTRICAL SHUNT CONNECTOR

FIELD OF THE INVENTION

This relates to the field of electrical connectors and more particularly to connectors for terminal posts.

BACKGROUND OF THE INVENTION

Shunt connectors are known which electrically connect two post terminals of a mating connector to allow commoning therebetween. One such shunt connector is manufactured by AMP do Brasil of Sao Paulo, Brazil under Part No. 880584-1 and comprises an integral stamped metal part contained in a dielectric housing. The shunt has two pairs of long cantilever beams extending from a body section which when the shunt is secured in the housing are disposed in respective housing cavities and extend toward a mating face of the housing, and the beam pairs are spaced at 0.100 inch centerlines. Each pair receives a terminal post thereinto with the beams deflected outwardly when the post is inserted into the respective housing cavity during mating, and the beams are inward smooth projections which comprise contact surfaces for firmly engaging sides of the post for assured electrical connection. The shunt is insertable into the housing from the front on top of a ledge separating the two cavities, and the shunt's body section is disposed near the back of the housing, secured in place by a forwardly and upwardly extending lance which is struck up from the body section by tooling after insertion to extend and latch in a corresponding housing latch recess. The tooling is insertable through an opening in the bottom housing wall. The outline of the lance is cut into the body section, but is essentially not struck out of the plane until after insertion. In order to reduce the size of the shunt and still maintain the beam length thereof which has provided proven performance, the body section would have to be substantially smaller which would make the prior art retention system unreliable. While the shunt connector is only about 0.4 inches long, it is desired in the industry to have a shunt connector having an axial length of only about 0.2 inches. It also includes a sizable pull tab extending rearwardly from the housing which increases the length almost another 0.200 inches thereto.

SUMMARY OF THE INVENTION

The present invention includes a stamped metal shunt having two coplanar pairs of cantilever beams extending forwardly from an axially short body section. The housing includes two coplanar post-receiving cavities intersected by a shunt-receiving cavity defined between narrowly spaced upper and lower surfaces between which the shunt is insertable from the mating face of the housing, with sides of the shunt-receiving cavity comprising narrow axial recesses along outer side walls of the post-receiving cavities. An aperture is located in the housing centered between the cavities extending to the bottom surface, spaced near from the mating face. The inside beams of the two pairs of beams of the shunt have projections struck down from their facing inner edges near the front ends thereof. The barbs latch in the housing aperture when the shunt is inserted. The upper surface between the post-receiving cavities is recessed at the front to allow the central portion of the front end of the shunt with its downwardly projecting barbs to bow upwardly during insertion, while outer sides of the shunt are held in the narrow recesses along the outer side walls of the two post-receiving cavities.

It is an objective of the present invention to provide a miniature low-profile shunt connector for placement in restricted areas, with cantilever contact beams having optimized length.

It is another objective of the present invention to provide a miniature shunt which is stamped and substantially not involving forming, with retention features for self-retention in a premolded housing.

BRIEF DESCRIPTION OF THE DRAWINGS

FIGS. 1 and 2 are top and front elevation views of the shunt of the present invention.

FIG. 3 is a perspective view with the shunt exploded from the front of the housing, which has its internal geometry displayed.

FIG. 4 is a longitudinal section view through the center of the housing prior to insertion of the shunt.

FIG. 5 is a top section view of the shunt secured within the housing.

DETAILED DESCRIPTION OF THE PREFERRED EMBODIMENT

Shunt 10 is stamped from a thin strip of metal such as phosphor—bronze alloy which is preferably plated with gold over nickel, or optionally tin. Two coplanar pairs of cantilever beams 12,14 extend axially forwardly from body section 16, and each pair of beams 12,14 includes a contact area comprising arcuate contact sections 18 extending toward each other from each beam 12,14 at the forward ends thereof. Outer beams 12 are angled slightly inwardly to provide for being deflected outwardly towards a corresponding housing sidewall upon receipt of a terminal post thereinto during mating (see FIG. 4). Inner beams 14 include projections 20 extending toward each other from inner edges 22 thereof, which are struck partially downwardly (FIG. 2) out of the plane of the shunt and have orthogonal front edges 24 comprising stop surfaces. Rearward corners 26 of body section 16 are chamfered to define lead-ins assisting during insertion of shunt 10 into housing 30.

Dielectric connecting housing 30 is premolded of thermoplastic resin such as polyester and comprises upper and lower walls 32,34 and sidewalls 36 extending therebetween. Shunt-receiving cavity 38 extends from mating face 40 to rear wall 42 and is just high enough to receive shunt 10 inserted thereinto and wide enough to receive shunt body section 16 therealong. Post-receiving cavity portions 44 are spaced apart along shunt-receiving cavity 38 on centerlines corresponding to the centerlines of the terminal posts (not shown) to be received thereinto such as 0.100 inches. At forward ends of post-receiving cavity portions 44 the edges are beveled to provide lead-ins for the terminal posts. Outer ends of shunt-receiving cavity 38 comprise axial recesses 46 which extend along outer wall surfaces of post-receiving cavities 44 to receive outer portions of outer beams 12 of shunt 10 when inserted. Between cavity portions 44 are upper and lower ledges 48,50 defining the center of shunt-receiving cavity 38, lower ledge 50 having a beveled front edge 52 for shunt lead-in purposes. The forward half 54 of upper ledge 48 is recessed (FIG. 4), ending at tapered transition surface 56. Proximate rear wall 42 are openings 58 and recesses 60 to facilitate handling during placement into and removal from an array of similar shunt connectors. Proximate mating face 40 aperture 62 extends through lower ledge 50 into shunt-receiving cavity 38 from the bottom surface of the housing and including at least a rearwardly facing surface 64. Aperture 62 comprises a latching recess and surface 64 a stop surface for shunt projections 20, when shunt 10 is inserted into housing 30.

In FIG. 3 shunt 10 is secured into housing 30 by being inserted through mating face 40 into shunt-receiving cavity 38. Outer sides of outer beams 12 are held in channel portions 64 outwardly of post-receiving cavity portions 44 and are slidable therealong. As the forward end of shunt 10 is about to enter cavity 38, downward projections 20 engage lead-in front edge 52 of lower ledge 50 causing inner shunt beams 14 to be deflected upwardly into recessed forward half 54 of upper ledge 48, and preferably rearward surfaces 28 of projections 20 are beveled or radiussed to minimize snagging. Upon full insertion as in FIG. 5 projections 20 latch behind stop surface 64 of housing aperture 62 when inner beams 14 resile. Preferably projections 20 are loosely disposed within aperture 62 to allow inner beams 14 to be freely deflectable by respective terminal posts inserted into the shunt connector.

Housing 30 preferably has rectilinear outer surfaces to permit relative vertical and side-to-side stacking as desired in an array of shunt connectors, with widths equal to or just less than 0.200 inches to allow side-to-side placement for an array of terminal posts on 0.100 inch centerlines and heights equal to or just less than 0.100 inches to similarly allow vertical placement for such a post array. Housing 30 has a desired low-profile axial length of about 0.2 inches to allow for a low profile shunt connector array on a printed circuit board so that another board or other component or panel can be spaced closely thereto.

The shunt of the present invention thus has retention projections from the contact beams without interfering with the electrical connection with mating terminal posts, which allows the body section to have a minimal axial length. The stamped shunt involves minimal forming and is easily inserted into the housing of the present invention. Variations may occur in the shunt or housing without departing from the spirit of the invention or the scope of the claims.

What is claimed is:

1. A miniature shunt connector for commoning a pair of terminal posts, comprising:

a conductive shunt stamped from a thin metal sheet and including a body section forwardly from which extend in a plane therewith outer cantilever beams and inner cantilever beams paired therewith to receive respective terminal posts therebetween, said inner cantilever beams having facing surfaces each having a latch projection struck downwardly therefrom, each projection including a forwardly facing stop surface; and a housing including a shunt-receiving cavity extending from a mating face to a rear wall and intersecting a pair of post-receiving cavity portions selectively spaced and adapted to receive thereinto a corresponding pair of terminal posts to be commoned, said shunt-receiving cavity having opposed upper and bottom surfaces, said housing including a rearwardly facing stop surface associated with said latch projections and proximate said mating face and along said bottom surface of said shunt-receiving cavity between said post-receiving cavity portions, whereby said shunt is insertable into said shunt-receiving cavity from said mating face and latchable therewithin, with the forwardly facing stop surfaces latching behind the rearwardly facing stop surface.

2. A miniature shunt connector as set forth in claim 1 wherein the upper surface of said shunt-receiving cavity is recessed near said mating face, whereby said inner beams of said shunt are temporarily deflectable upwardly during insertion of the shunt into the housing when said latch projections ride over said bottom cavity surface prior to latching behind said rearwardly facing stop surface.

3. A miniature shunt connector as set forth in claim 1 wherein said latch projections have tapered or radiussed rear surfaces to minimize snagging during insertion.

4. A miniature shunt connector as set forth in claim 1 wherein said rearwardly facing stop surface is defined by a forward wall surface of an aperture through a bottom wall of said housing.

5. A miniature shunt connector as set forth in claim 1 wherein outer surfaces of said housing are rectilinear and said housing has a height no greater than 0.100 inches and a width no greater than 0.200 inches, whereby said housing is adapted to be arranged in an array of like housings to common pairs of terminal posts of an array of such posts having centerlines spaced 0.100 inches apart.

6. A miniature shunt connector as set forth in claim 5 wherein said outer surfaces include recess means to receive tooling for handling thereof.

* * * * *